US006013011A

United States Patent [19]

Moore et al.

[11] Patent Number: 6,013,011

[45] Date of Patent: Jan. 11, 2000

[54] SUSPENSION SYSTEM FOR EXERCISE APPARATUS

[75] Inventors: Steve Moore; Thomas Moran, both of Seattle; Janine Whan-Tong, Woodinville, all of Wash.

[73] Assignee: Precor Incorporated, Bothell, Wash.

[21] Appl. No.: 08/825,513

[22] Filed: Mar. 31, 1997

[51] Int. Cl.[7] ..... A63B 22/02

[52] U.S. Cl. ..... 482/54; 482/51; 482/77

[58] Field of Search ..... 482/51–54, 77; 198/841

[56] References Cited

U.S. PATENT DOCUMENTS

| | | | |
|---|---|---|---|
| 4,344,616 | 8/1982 | Ogden . | |
| 4,350,336 | 9/1982 | Hanford . | |
| 4,423,864 | 1/1984 | Wiik . | |
| 4,974,831 | 12/1990 | Dunham . | |
| 4,984,810 | 1/1991 | Stearns et al. . | |
| 5,184,988 | 2/1993 | Dunham . | |
| 5,336,144 | 8/1994 | Rodden . | |
| 5,382,207 | 1/1995 | Skowronski et al. . | |
| 5,441,468 | 8/1995 | Deckers et al. | 482/54 |
| 5,454,772 | 10/1995 | Rodden . | |
| 5,484,362 | 1/1996 | Skowronski et al. . | |
| 5,562,575 | 10/1996 | Gvoich | 482/26 |
| 5,599,259 | 2/1997 | Skowronski et al. . | |

FOREIGN PATENT DOCUMENTS

| | | |
|---|---|---|
| 2616132 | 12/1988 | France . |
| 3601-184 | 1/1986 | Germany . |
| 1395344 | 5/1988 | U.S.S.R. . |
| WO81/01960 | 7/1981 | WIPO . |

*Primary Examiner*—Jerome Donnelly
*Attorney, Agent, or Firm*—Christensen O'Connor Johnson & Kindness PLLC

[57] ABSTRACT

A treadmill (10) includes a frame on which are mounted transverse forward and rearward roller assemblies (14, 16). An endless belt (18) is trained about the forward and rearward roller assemblies. A deck (20) is positioned between the upper run of the belt and the frame. The rearward portion of the deck (20) is mounted to the frame by a pivot connection (24) to allow pivoting of the deck about an axis transversely to the length of the deck. Elongate springs (26) of adjustable stiffness are mounted either along the sides of the frame to underlie the side margins of the deck, or transversely of the deck, to support the deck in conjunction with the pivot connection (24) and to absorb impact loads imparted on the deck by the user.

53 Claims, 6 Drawing Sheets

SUSPENSION SYSTEM FOR EXERCISE APPARATUS

TECHNICAL FIELD OF THE INVENTION

The present invention relates to exercise equipment, and more particularly to exercise treadmills, and still more particularly to suspension systems for supporting the deck of the exercise treadmill above an underlying frame structure.

BACKGROUND OF THE INVENTION

Exercise treadmills are widely used in spas, exercise clubs and also in individual residences to enable users to walk, jog or run indoors. This is especially useful during inclement weather and also at night or at other times when exercisers do not desire to run outdoors. Most exercise treadmills include first and second roller assemblies that are transversely mounted at the ends of a frame. An endless belt is trained about the roller assemblies. The upper run of the belt is supported by an underlying deck positioned between the belt and the frame.

Efforts have been made to reduce the impact on the user's limbs and joints when jogging or running on a treadmill. One method of reducing the impact on an exerciser's body is disclosed by U.S. Pat. Nos. 4,974,831 and 4,984,810. In the treadmills disclosed by these patents, the rear end of the deck is pivotally mounted to the frame, with the forward end of the deck supported by a suspension system. In the U.S. Pat. No. 4,974,831, the suspension system consists of a fairly complicated lever arm assembly and cooperating shock absorbers. Striding on a deck results in pivoting of the lever arms and extension of the shock absorbers, thereby to dampen the impact of the user's feet. A drawback of this shock absorption system is its complex nature, rendering it costly to manufacture.

In the U.S. Pat. No. 4,984,810, the forward end of the treadmill deck was supported by a conventional compression spring and separate shock absorber. Placement of the spring and shock absorber at the very front of the deck imposes considerable bending stress on the deck.

Other conventional treadmills have utilized rubber blocks positioned between the deck and the underlying frame to absorb impact. One such conventional treadmill is disclosed in French Patent No. 2,616,132. A treadmill deck is mounted above the frame members on a plurality of flexible pads. Bushings are inserted into the top and bottom of each pad, and bolts depending downwardly from the deck and upwardly from frame are received within the corresponding bushings. The bolts serve to position the flexible pads between the deck and frame for shock absorption.

U.S. Pat. Nos. 5,336,144 and 5,454,772 disclose a deck supported above a frame by a plurality of cup-shaped elastomeric springs. The elastomeric springs reversibly deform during downward deflection of the deck toward the frame. The elastomeric springs have side walls of tapering thickness. As a result, the resistance to the downward travel of the deck provided by the elastomeric springs is proportional to the degree of deflection of the deck toward the frame. One drawback of this particular treadmill construction is that the elastomeric springs are fixed in place and individually define a rather small bearing area.

SUMMARY OF THE INVENTION

The present invention provides an exercise treadmill having a frame, first and second roller assemblies rotatably mounted on the frame, and an endless belt trained about the first and second roller assemblies. The exercise treadmill also includes a deck disposed between the frame and the upper run of the belt. A pivot connection pivotally connects the rearward end portion of the deck to the frame. Elongate elastomeric spring members are disposed between the frame and the deck at a location intermediate the ends of the deck to support the deck spaced above the frame. The elastomeric springs reversibly deform to resist a deflection (downward movement) of the deck toward the frame when the exerciser strides on the endless belt. The resistance provided by the elastomeric spring members is proportional to the extent of deflection of the deck.

In a further aspect of the present invention, the elastomeric spring members are mounted on the side rails of the frame and underlie marginal side portions of the deck.

In another aspect of the present invention, the elastomeric springs include a base portion and a bulbous body portion extending upwardly from the base portion. The body portion is domed or crowned at its top to define an outwardly convex shape. The interior of the elastomeric spring between the base portion and the body portion is hollow or partially hollow. As a result, the body portion deflects downwardly under the force imposed on the deck by the exerciser.

In an additional aspect of the present invention, the wall thickness of the body portion of the elastomeric spring is greater at the intersection of the body portion with the base of the elastomeric spring. The wall thickness of the body portion decreases in the direction away from the base portion, reaching a minimum thickness at the top of the domed body portion. As a result, when the deck imparts a downward load on the elastomeric springs, the top central portion of the body portion of the elastomeric spring deflects downwardly into the hollow interior, rather than the body portion deflecting sideways, which could occur if the elastomeric spring was of solid construction. Also, the resistance imposed on the deck by the elastomeric spring increases as the deck deflects downwardly, thereby providing a variable rate spring.

In another aspect of the present invention, the spring may be constructed so that its rate of deformation may be selectively altered. In this regard, a compressible insert is sized and shaped to be selectively insertable to a desired degree into the hollow body portion of the spring. In cross-section, the insert may correspond to the cross-sectional shape of the hollow body portion of the spring. Also, the spring may be tapered along its length. In another configuration, the body portion of the spring may be adapted to receive a compressible fluid thereby serving as a bladder. In a more specific aspect of the present invention, the compressible fluid may be composed of air, with the air being supplied to the bladder by an air pump. Also in a more specific aspect of the present invention, a valve or other means may be provided for discharging the compressible fluid from the bladder.

In a further aspect of the present invention, the pivot connection at the rearward end of the deck includes a spindle mounted on the frame side member to engage with a hinge bracket mounted to the underside of the deck. By this construction, the rearward end portion of the deck is pivotally attached to the frame about an axis extending transversely to the length of the deck.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
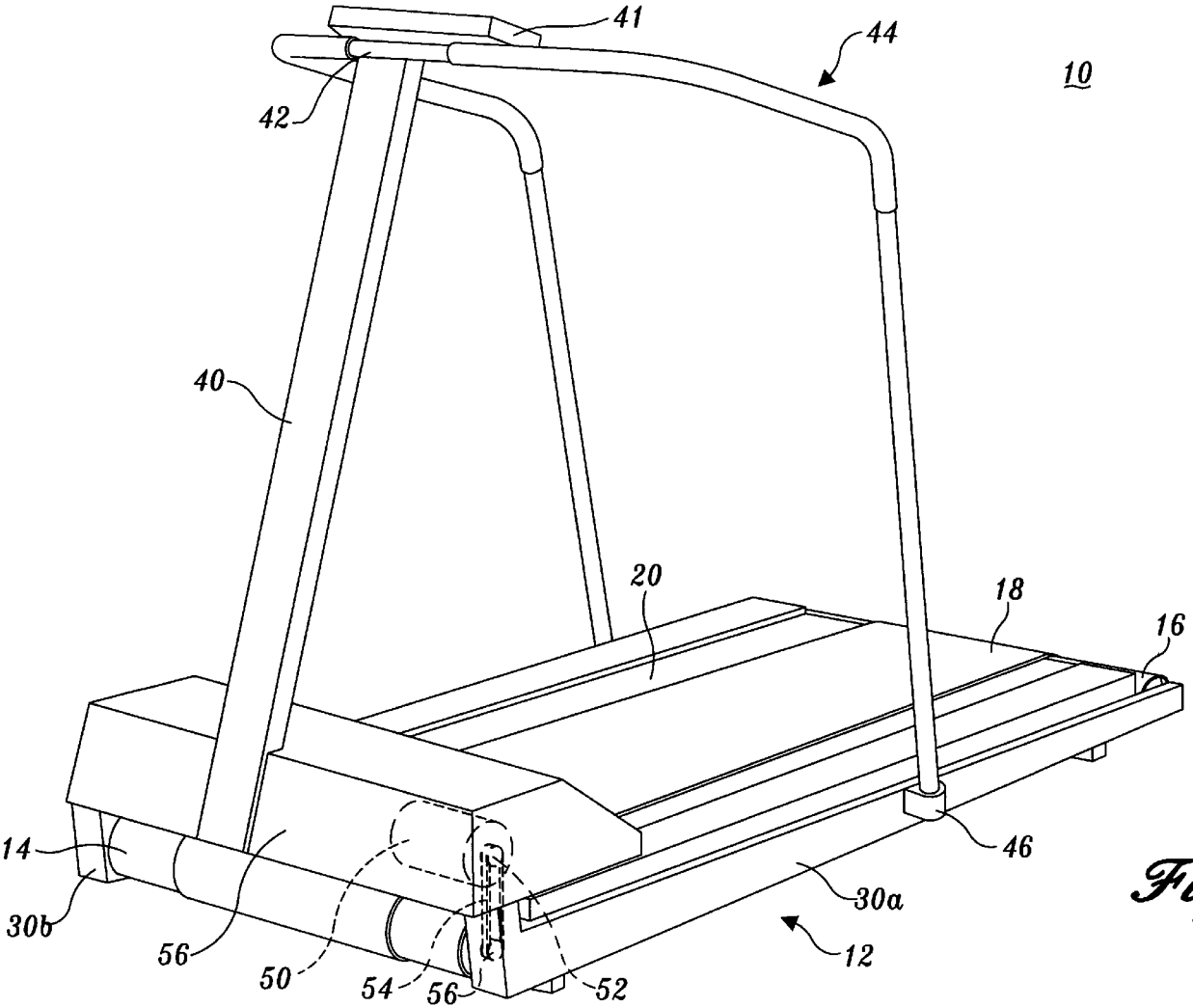
FIG. 1 is a pictorial view of an exercise treadmill constructed in accordance with the present invention.
Figure 2:
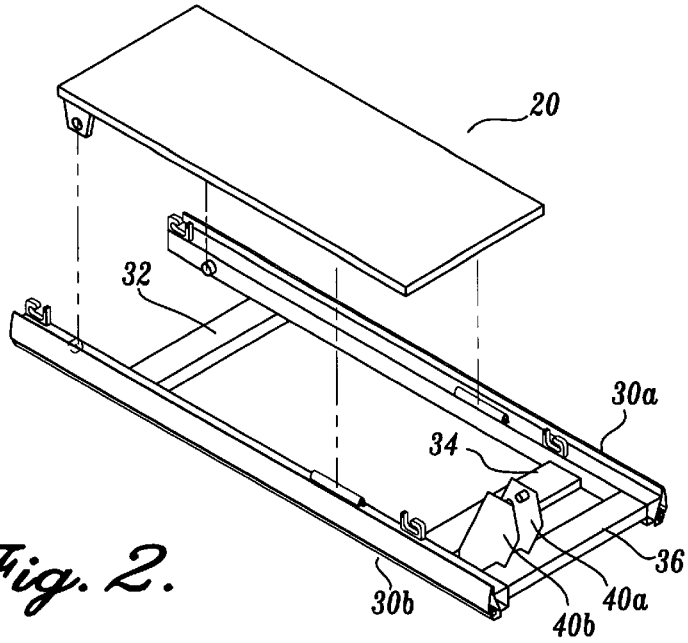
FIG. 2 is an exploded pictorial view of the frame, deck, pivot connection and elastomeric springs of the exercise treadmill of FIG. 1.
Figure 3:
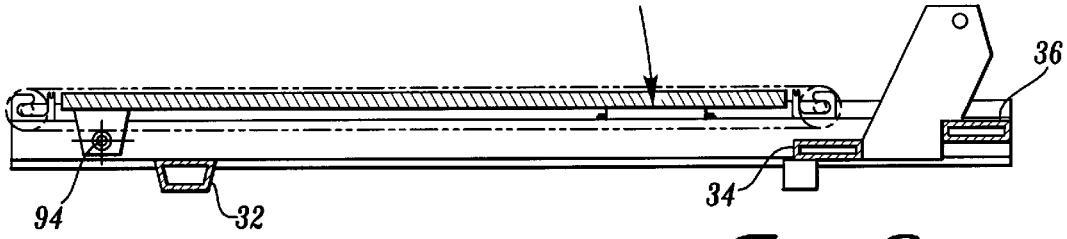
FIG. 3 is a partial cross-sectional view of the exercise treadmill shown in FIG. 1 taken substantially along lines 3—3 thereof.
Figure 5:
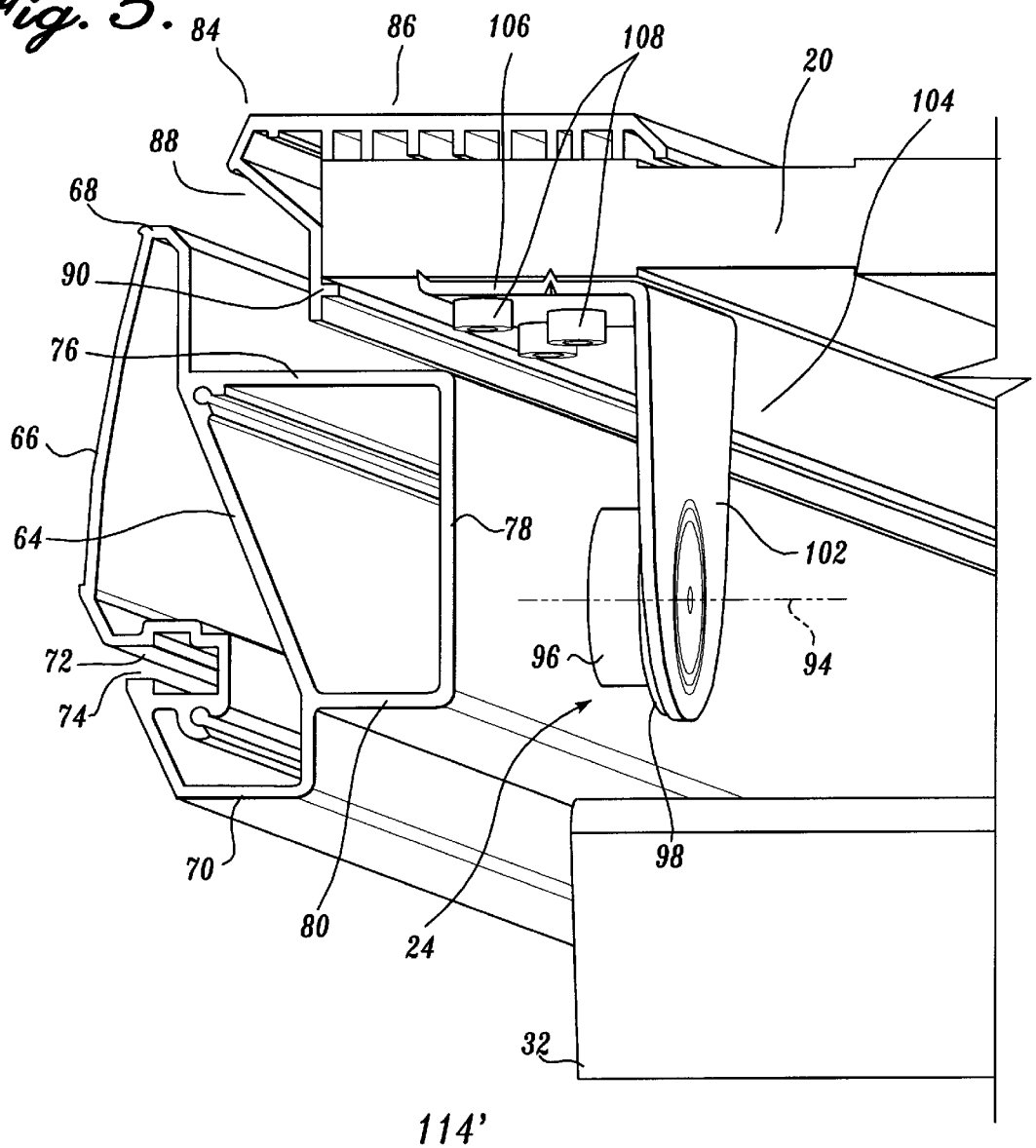
FIG. 5 is a further enlarged fragmentary pictorial view of the exercise treadmill of the present invention, specifically illustrating the pivot connection between the deck and the frame.

Initially referring to FIG. 1, a treadmill 10 constructed in accordance with the present invention includes a frame 12 on which is mounted a forward roller assembly 14 and a rearward roller assembly 16 are transversely mounted to the frame. For purposes of the present application, including the claims therein, the designation "forward end" refers to the direction in which the exerciser faces when using the treadmill. The terms "rear" and "forward" refer to opposite directions. An endless belt 18 is trained about the forward and rearward roller assemblies 14 and 16. A deck 20 is positioned between the upper run of the belt 18 and the frame 12. Referring additionally to FIGS. 2, 3 and 5, the rearward portion of the deck 20 is pivotally mounted to the frame by a pivot connection 24 to allow the rearward portion of the deck to pivot transversely to the frame about an axis extending relative to the length of the deck. Elongate, deformable springs 26 are mounted on the frame to underlie side margins of the deck to support the deck in conjunction with the pivot connection 24.

Describing the foregoing aspects of the present invention in greater detail, the frame 12 includes a pair of longitudinal, formed side rails 30A and 30B that are disposed in laterally spaced apart, parallel relationship to each other by a rearward cross member 32, an intermediate cross member 34 and a forward cross member 36. Ideally, the cross members are formed from hollow metal extrusions so as to provide a high strength to weight ratio. Brackets 38 are positioned on the frame side rails 30A and 30B to engage the ends of the roller assemblies 14 and 16; see FIGS. 2 and 3.

The frame 12 also includes a pair of planar mounting plates 40A and 40B that extend upwardly from a position between the intermediate and forward cross members 34 and 36 to support an upwardly extending post 40. The post 40 extends upwardly and forwardly from the forward end of the frame 12 to support the transverse section 42 of railing 44. The railing 44 extends rearwardly and slightly downwardly from transverse section 42 and thereafter extends primarily downwardly to terminate at lower ends that are secured to the frame by attachment brackets 46. The railing is manually graspable by the exerciser during walking, jogging or running on the treadmill 10.

The post 40 also supports a display panel 41 that displays various information during use of the treadmill, including speed of the belt, duration of the exercise, calories being burned, the course being run by the exerciser, etc. The display panel typically also includes various control knobs or buttons, for example, a start button, a speed control, an emergency shut off, etc.

The treadmill 10 further includes a motor 50 having a drive shaft 52 engaged by a drive belt 54 mounted on one end of forward roller assembly 14. The motor 50 rotatably drives the forward roller assembly 14 thus causing movement of the treadmill belt 18 on which an exerciser strides during use of the treadmill 10. The motor 50 is located within a formed housing cover 56 extending transversally across the forward end of the treadmill.

Figure 4:
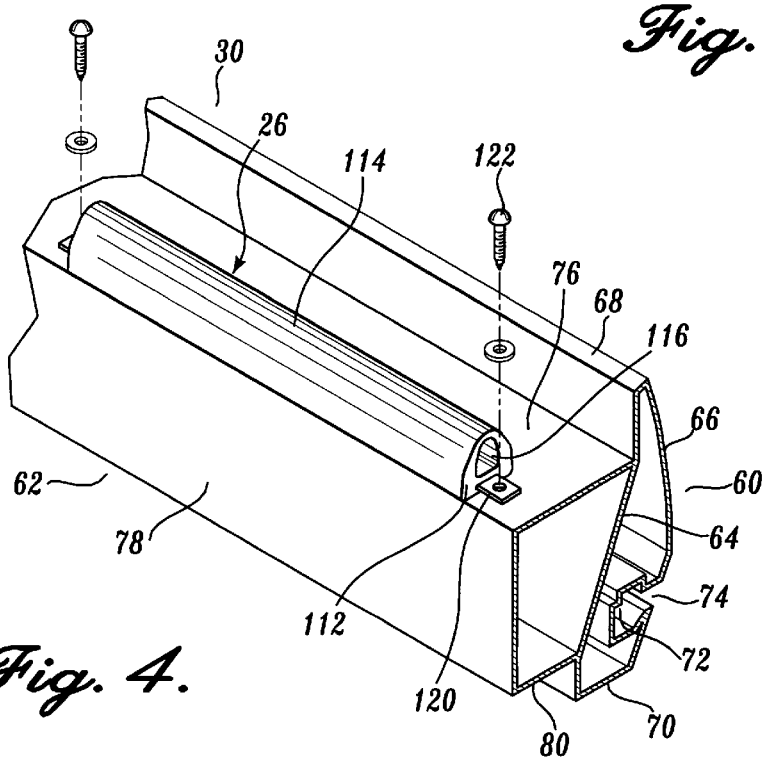
FIG. 4 is an enlarged fragmentary pictorial view of a portion of the frame of the exercise treadmill in the location of an elastomeric spring.

Next referring primarily to FIGS. 2–4, the side rails 30A and 30B are constructed as mirror images of each and thus the same part numbers will be used for the components of the side rails with the understanding that such part numbers refer to a corresponding components of the side rails. As shown most clearly in FIG. 4, the side rails 30A and 30B are composed of multi-cavity metal extrusions having an outward section 60 and an inward section 62 which share a common generally upright extending wall 64. In cross section, both the outward section 60 and the inward section 62 are constructed as closed box sections with the configuration of the outward section being somewhat more complicated than the inward section. In this regard, the outward section 60 includes a curved, outwardly convex, outer wall 66 extending downwardly from an upper lip 68 to a bottom horizontal wall 70. Between the upper lip 68 and the bottom wall 70, the outer wall defines an inwardly extending slot 72 having an entrance section 74 somewhat narrower than the height of the slot proper. Slot 72 is sized to slidably receive a corresponding shaped inward key portion (not shown) of bracket 46 which secures the lower ends of the railing 44 to the frame side rails.

Still referring specifically to FIG. 4, the side rail inward section 62 includes a substantially horizontal upper wall 76, a substantially vertical inward wall 78 and a substantially horizontal bottom wall 80, which cooperate with common wall 64 to define a closed, substantially rectangular, box-like cross section. As shown in FIG. 3, the rear cross member 32 bears against the bottom of the bottom wall 80. In addition, the lower edge of the intermediate cross member 34 is substantially flush with bottom wall 80, and the upper surface of the forward cross member 36 is substantially flush with the top wall 76. Moreover, as shown most clearly in FIGS. 2 and 3, the brackets 38 used for mounting the forward and rearward roller assemblies 14 and 16 are positioned on the top wall 76, which top wall functions as a shoulder member. Further, as will be discussed more fully below, of the elongate elastomeric springs 26 are also mounted on the top wall 76. It will be appreciated that the side rails 30A and 30B can be constructed differently than shown in the drawings and described above without departing from the spirit of scope of the present invention.

Referring primarily to FIGS. 2 and 3, the deck 20 is formed as a flat, rectangular, substantially rigid panel having smooth upper and lower surfaces. Suitable materials for forming the deck 20 include plywood or other reinforced wood structures, reinforced thermal set plastic materials, metal and other substantially rigid materials. Ideally the stiffness of the deck as defined by its EI (Modulus of Elasticity ($lb/in^2$)×Moment of Inertia ($in^4$)) is from about $0.5\times10^6$ to $2.0\times10^6$ lb. $In^2$. Preferably at least the upper surface of the deck is coated with or imbedded with a low friction coating, for instance, a wax composition.

As illustrated in FIG. 5, a formed trim strip 84 is mounted on each side margin of the deck 20 to protect the edge portions of the deck as well as to laterally constrain the belt 20. The trim strip 84 includes a top section 86 overlapping the top side margins of the deck, a side section 88 bearing against the side edges of the deck and a lower shoulder 90 overlapping the bottom side edge of the deck. Ideally, the trim strip 84 is formed from an extruded metallic or plastic material.

Still referring specifically to FIG. 5, pivot connection 24 includes two hinge assemblies, one at each side of the rearward portion of the deck, for mounting the deck rearward end portion to the frame side rail inward section 62 so as to pivot about a transverse axis 94. More specifically, each hinge assembly includes a mounting spindle 96 affixed to the inward surface of frame wall 78. A flange bearing 98 is mounted on a reduced diameter shoulder formed in the distal portion of spindle 96, with the web portion of the flange bearing closely fitting within a circular opening formed in the lower section of the vertical leg 102 of hinge bracket 104. The hinge bracket 104 includes an upper horizontal mounting plate portion 106 having clearance openings formed therein for receiving threaded fasteners that extend downwardly through the deck to engage hardware members 108 beneath plate 106.

It will be appreciated that other methods may be utilized to pivotally attach the rearward portion of the deck 20 to the frame 12. For example, a piano hinge, not shown, could be mounted to the underside of the deck 20 and to a frame cross member, not shown.

Next referring specifically to FIG. 4, the spring 26 is illustrated as being of a generally "d" cross-sectional shape. The spring 26 includes a base portion 112 that lies on top of frame top wall 76, and a bulbous, upwardly projecting, crowned or domed body section 114 that extends upwardly from the base portion to bear against the underside of the side margins of deck 20, see also FIGS. 2 and 3. The interior 116 of the spring 26 preferably is hollow or substantially hollow, to allow the downward deformation of the body section 114. Ideally, the body section 114 is not formed of a uniform wall thickness, rather the wall thickness decreases in the direction away from base portion 112, so that at the domed top of the body section 114 the wall thickness is approximately ⅓ to ½ the thickness of the body section at the intersection thereof with the base section 112.

The characteristics of spring 26 may also be altered by changing its cross-sectional dimensions. It is to be understood that the overall cross-sectional dimensions and size of the spring 26 may be increased to provide a stiffer spring or decreased to provide a less stiff spring. Also, the wall thickness at various positions about the cross section of the body section may be altered to change the characteristics of the spring.

In one preferred embodiment of the present invention, the width of the spring is approximately 1.0 to 1.5 inches wide, and the thickness of the base portion 112 is approximately 0.2 to 0.4 inches thick. Also the overall height of the spring is approximately 1 to 1.25 inches high. In addition, the wall thickness of the body section at its intersection with the base may be from 0.3 to 0.4 inches thick, and decreasing in thickness to approximately 0.1 to 0.2 inches at the top of the body section. It is to be understood that the foregoing dimensions were illustrative of a preferred embodiment of the present invention and are not considered to be restrictive of the scope of the present invention.

Ideally, the spring 26 is composed of an elastomeric material, such as a natural or synthetic rubber compound. It would be appreciated that the hardness of the rubber can be altered to thereby alter the spring rate and other characteristics of the spring 26. The spring 26 may be formed in selective lengths depending on the level of resistance to downward deformation of the spring desired.

Also, the spring 26 may be placed at a selected position along the length of the side rails 30A and 30B to achieve the desired the manner in which deck 26 reacts to impact loads imposed thereon by the exerciser. Ideally, the spring 26 is placed at the location along the side rails coinciding to where the exerciser's foot strikes the belt 18 above the deck 20.

The spring 26 is held in position by an elongate strap 120 that extends through a longitudinal slot formed in the base portion 112 of the spring. The ends of the strap 120 extend beyond the ends of the elastomeric spring to provide mounting tabs having clearance holes formed therein for receiving a threaded fastener extending downwardly through the tab and into the interior of frame rail wall 76. Other methods may be provided for securing the spring 26 to the frame rail.

Also, as noted above, the springs 26 may be selectively placed along the length of the frame rail to alter the energy absorbing and cushioning effects provided by the elastomeric spring. This may be accomplished by simply loosening the threaded fasteners 122 and re-engaging them within wall 76 at a different location along the frame rail.

Although the spring 26' is illustrated as mounted on the frame side rail, it could be instead mounted to the underside of deck 20, for instance, by engaging the threaded hardware member 122 upwardly into the underside of the deck 20.

Figure 6:
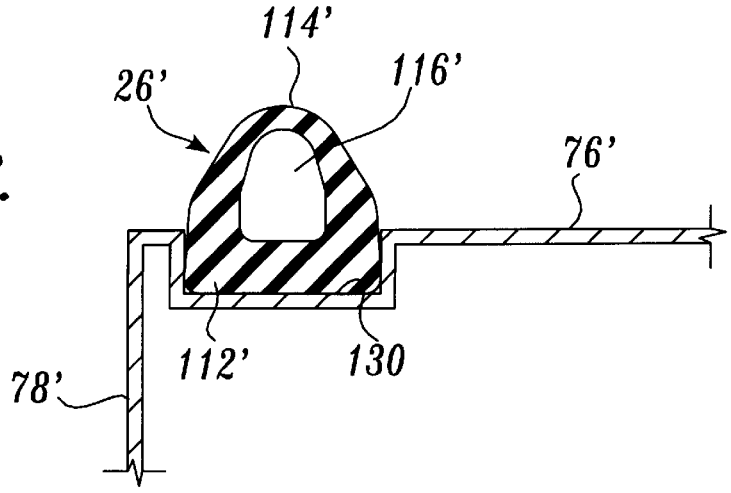
FIG. 6 is an enlarged partial cross-sectional view of an alternative embodiment of the present invention.

Spring 26 may be adapted to slide along the frame rail. This may be accomplished, for instance, by configuring the upper wall 76' of the frame rail to define an upwardly open channel 130 for receiving the spring 26' shown in FIG. 6. In FIG. 6 the components of the present invention are numbered to correspond to like components in the embodiment of the present invention shown in FIGS. 1–5, but with the addition of the prime "'" designation. Any convenient method may be used to retain the spring 26' stationary with channel 130 in the lengthwise direction.

When the treadmill 10 of the present invention is in use, as the exerciser's foot lands on belt 18, the treadmill deck is deflected (moves) downwardly toward frame 12. This deflection is resisted by compression of the springs 26. The springs 26 act to absorb the shock of the impact of the exerciser's feet. Because the treadmill deck is pivotally mounted at its rearward end and otherwise supported only by the springs, the treadmill deck 20 is free to move (pivot) up and down relative to the treadmill frame 20. Downward deflection of the deck 20 towards the frame 12 results in a reversible compression of the springs 26. In particular, the top central section of the spring body section 114 initially deflects centrally downwardly due to this portion of the bulbous section being thinner than at the intersection of the spring base portion 112. However, as the deck 20 continues to travel downwardly toward frame 12, increasingly thicker sections of the body section 14 must be compressed or deformed. The springs 26 thus become increasingly "stiffer" with further compression, offering a degree of resistance to the downward movement of the deck 20 that increases in proportion to the extent of travel of the deck 20.

Moreover, the body section 114 of the elastomeric spring is thinnest at the top of the body section. As a result, the body section 114 deflects centrally downwardly rather than tending to deflect sideways as it deforms, which in turn would place a lateral load on the deck 20. This tendency to deflect laterally or sideways is not present by virtue of constructing the body section 114 with an increasingly thinner wall section in a direction from base 112 to the top or crown of the bulbous section.

Because the degree of resistance to the downward movement of the deck 20 provided by springs 26 is proportional to the extent of the deflection or downward movement of the deck, the treadmill 10 provides a suitable shock absorption for exercisers of varied weights. Individuals who are lighter in weight do not impart as great an impact force on the treadmill deck during foot fall. Nevertheless, the treadmill deck 20 deflects downward toward the treadmill frame because of the relatively "easy" initial compression of the springs 26', thereby providing suitable shock absorption for lighter weight individuals. When individuals of greater weight use treadmill 10, greater impact loads are imparted to the treadmill deck 20, which loads are met with proportionally greater resistance by the springs 26 because of the proportionally greater downward deflection of the deck 20.

Figure 7:
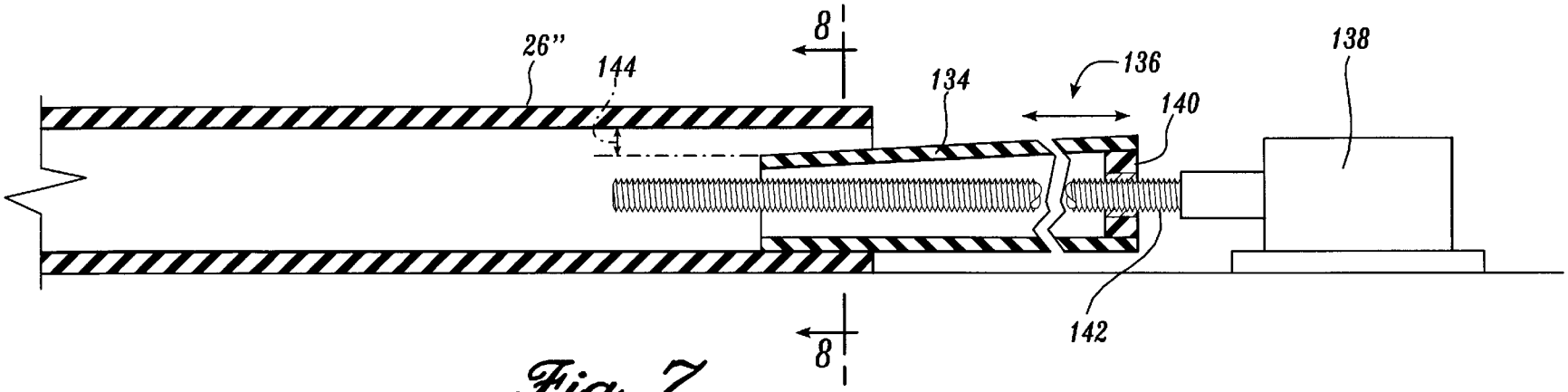
FIG. 7 is an enlarged elevational schematic view of another preferred embodiment of the present invention
Figure 8:
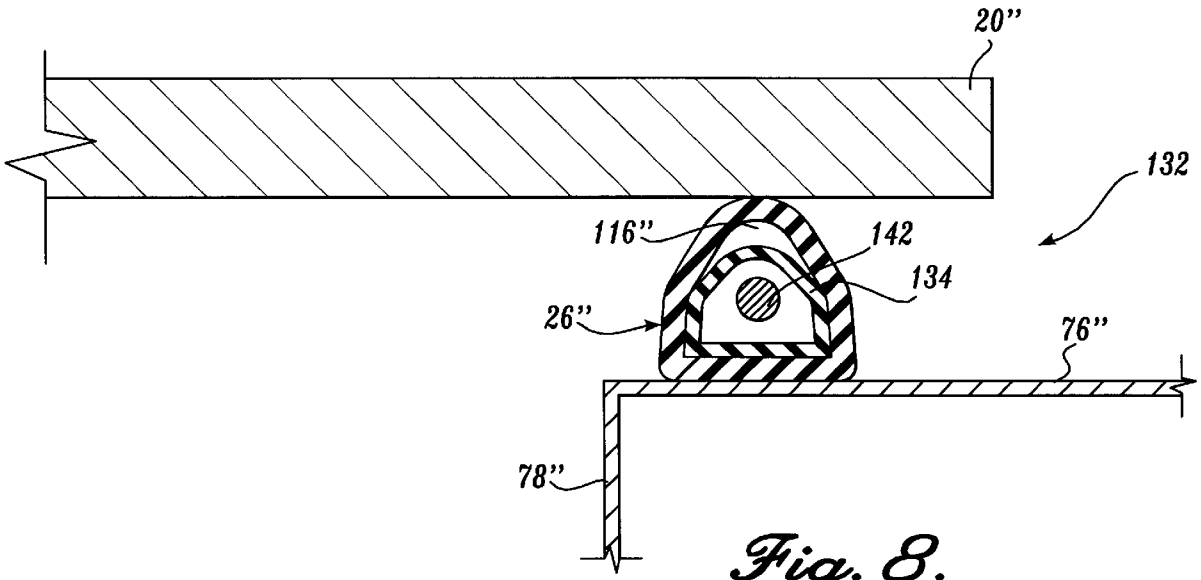
FIG. 8 is a cross-sectional view of the embodiment shown in FIG. 7 taken substantially along lines 8—8 thereof.

The embodiment of the present invention shown in FIGS. 7 and 8 pertains to a spring assembly 132 composed of a bulbous or hollow spring 26" that may be constructed similarly to springs 26 and 26' described above. The spring assembly 132 also includes an insert member 134 shaped and sized to be receivable within the hollow interior 116" of spring 26". Preferably, but not mandatorily, the exterior shape of insert 134 generally corresponds to the interior shape of the hollow interior 116" of the spring 26". Also ideally the insert 134 is of a length coinciding with the significant portion of the length of the hollow interior of the spring 26". It will be appreciated that spring 26" and insert 134 cooperatively form an assembly 132 to support the treadmill deck 20".

The purpose of insert 134 is to alter the characteristics of spring assembly 132. To this end, the insert 134 may be formed from material either similar to or dissimilar from the material of which spring 26" is composed. For example, the insert 134 may be formed from material that is harder or softer, less or more elastic, etc. relative to the material of which spring 26 is composed. Also, the insert may be of solid, hollow or partially hollow construction depending on how stiff or flexible it is desired to construct the insert. The particular material composition and construction of insert 134 is selected to cooperate with spring 26" to achieve the desired overall characteristics of spring assembly 132.

In addition to the material from which insert 134 is composed, the overall characteristics of the spring assembly 132 can be altered by changing the extent to which the insert 134 is engaged within the interior of spring 26". As shown in FIG. 7, ideally insert 134 may be selectively engaged within and disengaged from the exterior spring 26" by an actuator system 136. The actuator system 136 is illustrated as including a powered actuator 138 interconnected with the adjacent end wall 140 of the insert 134 through a connecting shaft 142. Actuator 138 may be of various types, for instance, a linear push-pull actuator in the form of a fluid cylinder or a magnetic coil assembly. Alternatively, the actuator 138 may be of a rotary type, for instance, powered by an electrical rotary motor. In this instance, connecting shaft 142 would be in the form of a lead screw to threadably engage end wall 140. The actuator 136 may be remotely operated by the user through control buttons or other interface device located on display panel 41, see FIG. 1.

As further shown in FIG. 7, the insert 134 may be tapered along its length to provide a variable gap 144 between the top of the insert 134 and the underside of the spring 26". By this construction, the spring 26" is deformable downwardly at a particular spring rate, which spring rate will increase when the top wall of spring 26" collapses sufficiently to bear against the top of the insert 134. As would be appreciated, by this construction the spring assembly 132 could initially provide a relatively low level of resistance to the downwardly movement of deck 20" and then provide a relatively higher level of resistance to the further downward movement of the deck once spring 26" has collapsed sufficiently to eliminate gap 144.

Figure 9:
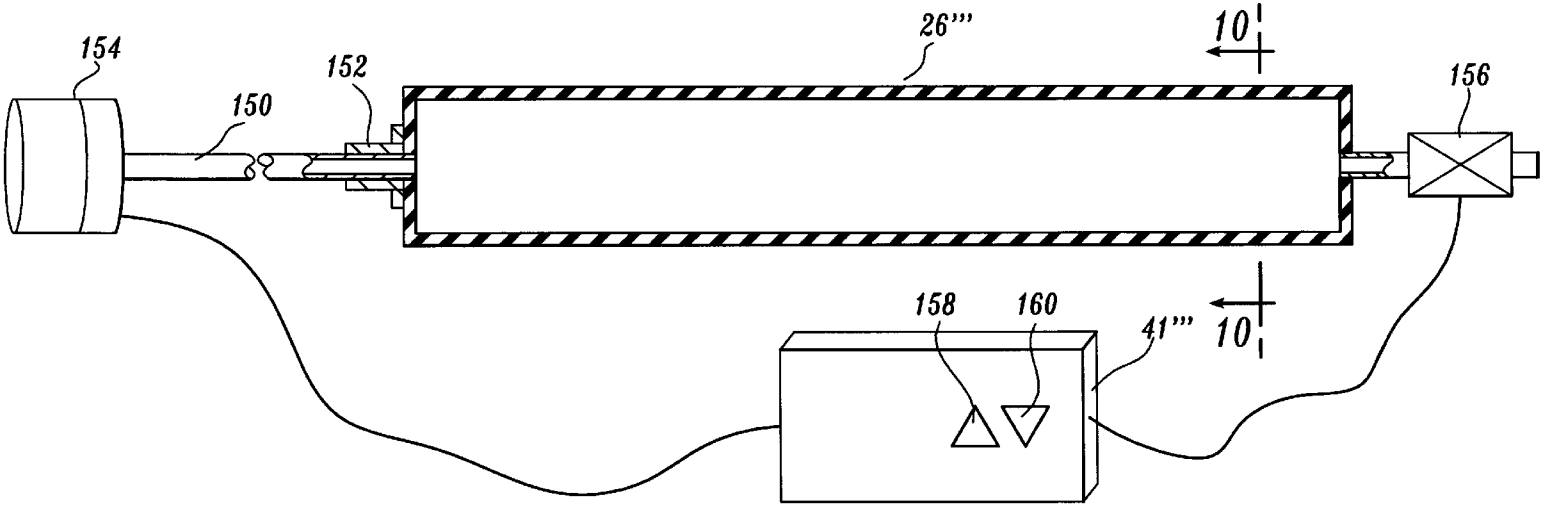
FIG. 9 is an enlarged elevational schematic view of a further preferred embodiment of the present invention.
Figure 10:
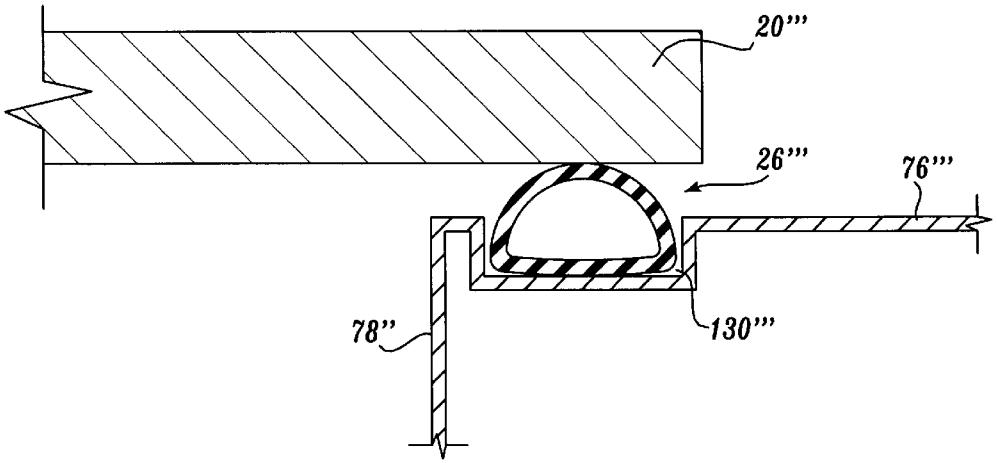
FIG. 10 is a cross-sectional view of FIG. 9 taken substantially along lines 10—10 thereof.
Figure 11:
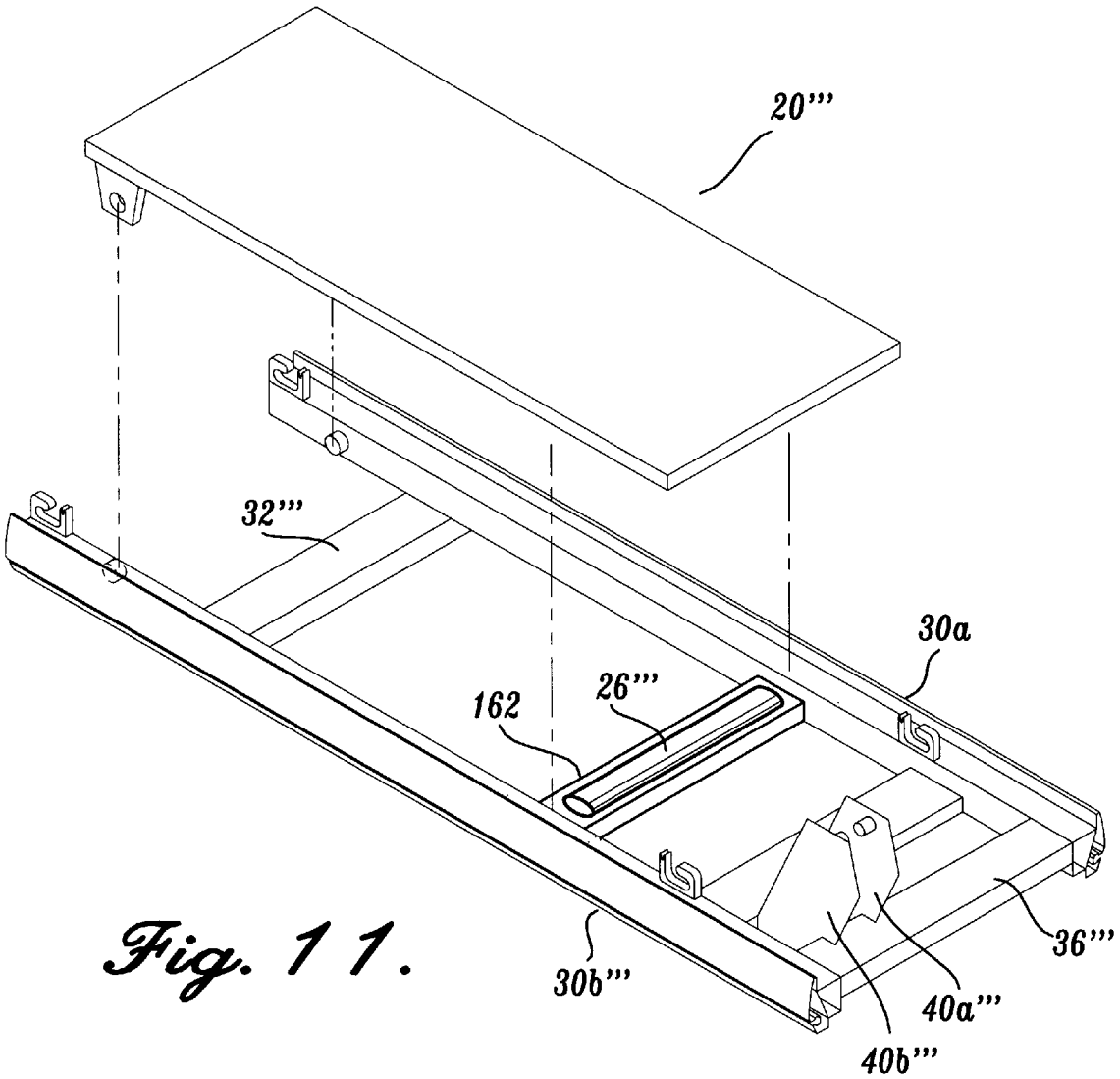
FIG. 11 is an exploded pictorial view of a further preferred embodiment of the present invention.

Another embodiment of the present invention is shown in FIGS. 9–11 wherein a spring 26''' is in the form of a fluid bladder sized to be receivable within an upwardly open channel 130''' formed in upper wall 76''' of the frame rail. As shown in FIG. 9, the bladder 26''' is adapted to bear against the underside of deck 20''' thereby to support the deck. Although the bladder is shown as having a generally oval cross-section, the bladder can be formed in other cross-sectional shapes, such as round, square or rectangular.

A compressible fluid, e.g., air, is supplied to the bladder 26''' through a supply hose 150 connected to an inlet formed in the bladder 26'''. If air is used as the compressible fluid, an air compressor 154 may be employed as a supply source. The compressible fluid may be expelled from the bladder 26''' through an outlet valve 156 in fluid flow communication with the bladder. Alternatively, valve 156 may be connected in fluid flow communication with supply hose 150 or incorporated into the construction of compressor 154. As will be appreciated, the "stiffness" of bladder 26''' will be depended on the pressure of the compressible fluid within the bladder, which may be remotely controlled by depressible buttons 158 and 160 located on display panel 41'''.

Rather than utilizing two bladders 26''', each mounted on a side rail of the treadmill frame, a single bladder 26''' may be mounted on frame crossmember 162 shown in FIG. 11. This crossmember may be stationary relative to the frame or adapted to be positionable along the length of the frame to alter the location along the length of the deck 20''' supported by the bladder 26'''. It will be appreciated that bladder 26''' may be replaced by spring assembly 132 mounted on crossmember 162.

It will be appreciated that by constructing springs 26, 26', 26", 26''' in the elongated configuration as described above and as illustrated in the drawings, and by placing the spring between the frame and the deck, a substantial interface length or area is achieved between the spring and the deck thereby reducing or minimizing bearing or contact stresses, while at the same time requiring very little vertical height, which enables the springs to be readily and conveniently installed. Also, the construction of the springs of the present invention comprise very few components which facilitates their manufacture, assembly, installation, maintenance and reliability.

The present invention has been described above in terms of a preferred embodiment and several variations thereof It is to be understood that other modifications, alternations and substitutions are possible within the scope of the present invention. It is thus intended that the scope of the Letters Patent granted hereon is to be limited only by the limitations of the appended claims.

The embodiments of the invention in which an exclusive property or privilege is claimed are defined as follows:

1. An exercise treadmill comprising:

(a) a frame;

(b) first and second roller assemblies rotatably mounted on the frame;

(c) an endless belt trained around the first and second roller assemblies:

(d) a deck disposed between the frame and the upper run of the endless belt, the deck having a first end portion and a second end portion;

(e) a pivot connection to pivotally connect the second end portion of the deck to the frame to enable the second end portion of the deck to pivot about an axis generally transversely to the length of the deck, the pivot connection vertically supporting the second end portion of the deck and simultaneously supporting the deck for pivotal movement relative to the frame; and (f) at least one elongated spring disposed between the frame and the deck at a location between the first and second end portions of the deck to absorb loads imparted on deck by the exerciser, the spring being disposed so that the length of the spring is generally parallel to the plane of the deck.

2. The exercise treadmill of claim 1, wherein the spring is disposed between the frame and the underside of the deck.

3. The exercise treadmill of claim 2, wherein the spring is disposed lengthwise of the deck.

4. The exercise treadmill of claim 2, wherein the spring is disposed transversely relative to the length of the deck.

5. The exercise treadmill of claim 1, wherein the frame includes a pair of laterally spaced apart side rails, and a spring is disposed between each frame side rail and the deck.

6. The exercise treadmill of claim 5, wherein the springs are positioned between the frame side rails and the underside of the deck.

7. The exercise treadmill of claim 6, wherein the springs are disposed lengthwise of the frame side rails.

8. The exercise treadmill of claim 5, wherein the frame includes at least one cross-member extending transversely between the frame side rails, and a spring is disposed between the crossmember and the underside of the deck.

9. The exercise apparatus of claim 8, wherein the spring is disposed lengthwise of the crossmember.

10. The exercise treadmill of claim 1, wherein the spring provides resistance to the movement of the deck towards the frame under loads imposed by the exerciser in proportion to the extent of movement of the deck towards the frame.

11. The exercise treadmill of claim 1, wherein the spring has a variable spring rate, the spring rate increasing with deflection of the spring.

12. The exercise treadmill of claim 11, wherein the spring is comprised of elastomeric material.

13. The exercise treadmill of claim 1, wherein the spring rate of the spring is adjustable.

14. The exercise treadmill of claim 13, wherein the spring is composed of elastomeric material.

15. The exercise treadmill of claim 1, wherein the spring is reversibly deformable under loads imposed on the deck by the exerciser.

16. The exercise treadmill of claim 15, wherein the extent of deformation of the spring per unit load imposed thereon by the deck decreases with increasing loads imposed on the elastomeric spring.

17. The exercise treadmill of claim 16, wherein the spring is composed of elastomeric material.

18. The exercise treadmill of claim 1, wherein the spring is at least partially hollow.

19. The exercise treadmill of claim 18, wherein the spring comprises elastomeric material having a base portion and a concave deformable portion extending from the base portion.

20. The exercise treadmill of claim 19, wherein the concave portion of the elastomeric spring has a wall thickness that decreases in the direction away from the base portion of the elastomeric spring.

21. The exercise treadmill of claim 19, wherein the elastomeric spring includes means for mounting the base portion of the spring to the frame.

22. The exercise treadmill of claim 19:

wherein the concaved deformable portion is at least partially hollow; and further comprising a compressible insert sized and shaped to be selectively insertable to a desired degree into the hollow concave portion.

23. The exercise treadmill of claim 22, wherein the insert in cross-sectional shape generally corresponds to the cross-sectional shape of the hollow interior of the concave deformable portion.

24. The exercise treadmill of claim 22, wherein the insert is tapered along its length.

25. The exercise treadmill of claim 22, further comprising means for altering the extent of engagement of the insert into the spring.

26. The exercise treadmill of claim 22, wherein the insert is composed of elastomeric material.

27. The exercise treadmill of claim 18, wherein the spring comprises: a bladder adapted to receive a compressible fluid; means for supplying compressible fluid to the bladder; and means for removing the compressible fluid from the bladder.

28. The exercise treadmill of claim 27, wherein: the compressible fluid comprises air, and further comprising an air pump for forcing air into the bladder.

29. The exercise treadmill of claim 27, wherein the frame comprises a recess for receiving the bladder therein.

30. The exercise treadmill of claim 1, further comprising mounting means for mounting the spring at selected locations on the frame lengthwise of the deck.

31. The exercise treadmill of claim 1, wherein the pivot connection includes a spindle mounted on one of the frame and deck second end portion, and a hinge bracket mounted on the other of the frame and deck end second portion of the deck.

32. The exercise treadmill of claim 1, wherein the deck is substantially rigid.

33. The exercise treadmill of claim 32, wherein the deck has a stiffness in terms of its EI of between $0.5\times10^6$ and $2.0\times10^6$ lb.in$^2$.

34. An exercise treadmill, comprising:

(a) a frame;

(b) first and second roller assemblies rotatably mounted on the frame;

(c) an endless belt trained about the first and second roller assemblies;

(d) a deck disposed between the frame and the upper run of the endless belt, the deck having a first end portion and a second end portion;

(e) a pivot connection to pivotally connect the second end portion of the deck to the frame to pivot about an axis extending generally transversely to the length of the frame, the pivot connection supporting the second end portion of the deck in the direction toward and away from the upper run of the endless belt and also supporting the deck for pivotal movement relative to the frame; and (f) at least one elongated spring extending lengthwise of the deck and disposed between the frame and the deck at a location between the first end portion of the deck and the pivot connection to support the deck relative to the frame in cooperation with the pivot connection, to absorb loads imparted on the deck by the exerciser and to resist movement of the deck toward the frame when an exerciser strides on the belt.

35. The exercise treadmill of claim 34, wherein:

the frame comprising a pair of elongated side rails laterally spaced apart from each other by a plurality of cross members; and, a spring is disposed between each side rail and the underside of the deck.

36. The exercise treadmill of claim 34, wherein the springs are reversibly deformable to resist movement of the deck towards the frame under loads imposed on the deck by the exerciser.

37. The exercise treadmill of claim 36, wherein springs provide resistance to the movement of the deck toward the frame at a level proportional to the extent of movement of the deck toward the frame.

38. The exercise treadmill of claim 37, wherein the rate of reversible deformation of the springs is inversely proportional to the level of deformation of the springs.

39. The exercise treadmill of claim 38, wherein the springs are composed of elastomeric material.

40. The exercise treadmill of claim 34, wherein the spring rate of the spring is adjustable.

41. The exercise treadmill of claim 40, wherein the spring comprises: a bladder adapted to receive compressible fluid; means for supplying a compressible fluid to the bladder; and, means for expelling compressible fluid from the bladder thereby to alter the volume of compressible fluid in the bladder.

42. The exercise treadmill of claim 41, wherein the frame includes a recess for receiving the bladder therein to assist in positioning the bladder relative to the frame.

43. The exercise treadmill of claim 34, wherein the spring is at least partially hollow.

44. The exercise treadmill of claim 43, wherein the spring comprises a base portion and an outwardly concave bulbous body portion extending from the base portion.

45. The exercise treadmill of claim 44, wherein the bulbous body portion of the spring is composed of elastomeric material.

46. The exercise treadmill of claim 44, wherein the bulbous body portion of the spring decreases in wall thickness in the direction away from the base portion.

47. The exercise treadmill of claim 44, further comprising means for mounting the springs at selected locations lengthwise of the frame side rails.

48. The exercise treadmill of claim 43, further comprising an insert sized and shaped to be insertable to a selective degree within the hollow portion of the spring.

49. The exercise treadmill of claim 48:

the spring is hollow along a substantial portion of its length; and, the insert is of a length equal to at least half of the length of the hollow portion of the spring.

50. The exercise treadmill of claim 48, wherein the insert is tapered along its length.

51. The exercise treadmill of claim 48, further comprising means for incrementally inserting the insert into the spring and retracting the insert from the spring.

52. The exercise treadmill of claim 34, wherein the pivot connection comprising a hinge assembly connected between the second end portion of the deck and the frame to pivot the second end portion of the deck about an axis extending generally transversely to the length of the deck.

53. The exercise treadmill of claim 52, wherein the hinge means includes a spindle positioned at the transverse pivot axis of the hinge means and a hinge bracket engaged with the spindle and attached to one of the deck second end portion and the frame.

* * * * *

UNITED STATES PATENT AND TRADEMARK OFFICE

CERTIFICATE OF CORRECTION

PATENT NO. : 6,013,011

DATED : January 11, 2000

INVENTOR(S) : S. Moore et al.

It is certified that error appears in the above-identified patent and that said Letters Patent is hereby corrected as shown below:

| Column | Line | |
|---|---|---|
| **On the Title Page:** | | |
| [56] Pg. 1, col. 2 | Refs. Cited (Foreign Publs.) | at the appropriate place in the list of foreign references, please insert --A63B 19/00 03/1981 Korea-- |
| 1 | 28 | before "U.S." delete "the" |
| 1 | 36 | before "U.S." delete "the" |
| 1 | 48 | before "frame" insert --the-- |
| 4 | 22 | "transversally" should read --transversely-- |
| 4 | 25 | after "each" insert --other-- |
| 4 | 28 | before "corresponding" delete "a" |
| 4 | 65 | "spirit of scope" should read --spirit or scope-- |
| 5 | 7 | "$In^2$." should read --$in^2$.-- |
| 5 | 42 | ""d"" should read --"D"-- |
| 6 | 18 | after "desired" delete "the" |
| 7 | 49 | after "etc." insert --,-- |
| 8 | 15-16 | "downwardly" should read --downward-- |

UNITED STATES PATENT AND TRADEMARK OFFICE

CERTIFICATE OF CORRECTION

PATENT NO. : 6,013,011

DATED : January 11, 2000

INVENTOR(S) : S. Moore et al.

It is certified that error appears in the above-identified patent and that said Letters Patent is hereby corrected as shown below:

| | | |
|---|---|---|
| 8 | 38-39 | "will be depended on" should read --will depend on-- |
| 8 | 61 | "comprise" should read --comprises-- |
| 8 | 61 | after "components" insert --,-- |
| 8 | 65 | after "thereof" insert --.-- |
| 8 | 66 | "alternations" should read --alterations-- |
| 9 (Claim 1, | 25 line 20) | after "imparted on" insert --the-- |
| 10 (Claim 22, | 17 line 2) | "concaved" should read --concave-- |

Signed and Sealed this

Twenty-seventh Day of March, 2001

*Attest:*

*Attesting Officer*

Nicholas P. Godici

NICHOLAS P. GODICI

*Acting Director of the United States Patent and Trademark Office*